US009208964B2

(12) United States Patent
Dudgeon et al.

(10) Patent No.: US 9,208,964 B2
(45) Date of Patent: Dec. 8, 2015

(54) LOCKOUT DEVICE

(71) Applicant: Master Lock Company LLC, Oak Creek, WI (US)

(72) Inventors: Matthew T. Dudgeon, Whitefish Bay, WI (US); Cecile Frot, Arcueil (FR); David Campbell, Richmond (AU); Lloyd Fenn, Middle Park (AU)

(73) Assignee: MASTER LOCK COMPANY LLC, Oak Creek, WI (US)

( * ) Notice: Subject to any disclaimer, the term of this patent is extended or adjusted under 35 U.S.C. 154(b) by 263 days.

(21) Appl. No.: 13/792,715

(22) Filed: Mar. 11, 2013

(65) Prior Publication Data

US 2014/0165384 A1 Jun. 19, 2014

Related U.S. Application Data

(60) Provisional application No. 61/737,311, filed on Dec. 14, 2012.

(51) Int. Cl.
*H01H 9/28* (2006.01)

(52) U.S. Cl.
CPC ..... *H01H 9/283* (2013.01); *Y10T 29/49105* (2015.01)

(58) Field of Classification Search
CPC ..... H01H 9/28; H01H 27/10
USPC ..... 200/43.02–43.22
See application file for complete search history.

(56) References Cited

U.S. PATENT DOCUMENTS

| | | | |
|---|---|---|---|
| 1,983,902 | A | 12/1934 | Hanny |
| 2,169,860 | A | 8/1939 | Von Hoorn |
| 2,192,060 | A | 2/1940 | Wise |
| 2,849,552 | A | 8/1958 | Firestone |
| 2,943,162 | A | 6/1960 | Norden |
| 2,978,613 | A | 4/1961 | Hein |

(Continued)

FOREIGN PATENT DOCUMENTS

| | | |
|---|---|---|
| EP | 0999568 | 5/2000 |
| FR | 0172771 | 2/1986 |
| GB | 2285887 | 7/1995 |

OTHER PUBLICATIONS

Universal Lockout Device for Fuse Holders (Model: UFL2), sold by Rececesafety (the internet page was retrieved on Jan. 22, 2015, originally published on Jan. 11, 2011).*

(Continued)

*Primary Examiner* — Edwin A. Leon
*Assistant Examiner* — Iman Malakooti
(74) *Attorney, Agent, or Firm* — Calfee, Halter & B Griswold LLP

(57) ABSTRACT

A lockout device includes a body, a clamp, and a cover. The body includes a recess and a first lock passage extending from a first opening in an upper surface to a second opening in a rear surface. The clamp is assembled with a clamp retaining portion of the body. The cover is connected with the body and is movable between a lockout position covering at least a portion of the clamp and a release position uncovering the clamp to permit adjustment. The cover includes first and second cutouts. When the cover is in the lockout position, the first and second cutouts align with the first and second openings of the body to permit insertion of a lock member through the first lock passage, thereby preventing movement of the cover from the lockout position to the release position.

21 Claims, 12 Drawing Sheets

(56) References Cited

U.S. PATENT DOCUMENTS

| | | | |
|---|---|---|---|
| 2,983,799 | A | 5/1961 | Osieja et al. |
| 3,076,876 | A | 2/1963 | Stanback et al. |
| 3,214,530 | A | 10/1965 | Tharp et al. |
| 3,255,320 | A | 6/1966 | Norden |
| 3,288,954 | A | 11/1966 | Norden |
| 3,291,924 | A | 12/1966 | Tharp |
| 3,312,794 | A | 4/1967 | Hollyday |
| 3,376,400 | A | 4/1968 | Batt et al. |
| 3,388,224 | A | 6/1968 | Higgins |
| 3,408,466 | A | 10/1968 | Palmer |
| 3,426,164 | A | 2/1969 | Dessert |
| 3,470,336 | A | 9/1969 | DeAngelo |
| 3,475,930 | A | 11/1969 | Foote |
| 3,566,326 | A | 2/1971 | Middendorf et al. |
| 3,595,040 | A | 7/1971 | Curl |
| 3,649,784 | A | 3/1972 | Middendorf et al. |
| 3,678,228 | A | 7/1972 | Adamson |
| 4,006,324 | A | 2/1977 | Leasher et al. |
| 4,160,137 | A | 7/1979 | Clement et al. |
| 4,185,478 | A | 1/1980 | Stintzi |
| 4,260,861 | A | 4/1981 | DiMarco |
| 4,347,412 | A | 8/1982 | Mihara et al. |
| 4,467,152 | A | 8/1984 | Gordy |
| 4,491,897 | A | 1/1985 | Troebel |
| 4,554,421 | A | 11/1985 | Grunert et al. |
| 4,677,261 | A | 6/1987 | Nourry |
| 4,704,504 | A | 11/1987 | Jones et al. |
| 4,733,029 | A | 3/1988 | Kobayashi et al. |
| 4,882,456 | A | 11/1989 | Hovanic et al. |
| 4,897,515 | A | 1/1990 | Zubar et al. |
| 4,978,816 | A | 12/1990 | Castonguay et al. |
| 5,079,390 | A | 1/1992 | Costanzo et al. |
| 5,113,043 | A | 5/1992 | Morris |
| 5,122,624 | A | 6/1992 | Benda |
| 5,147,991 | A | 9/1992 | Jordan, Sr. |
| 5,148,910 | A | 9/1992 | Williams |
| 5,165,528 | A | 11/1992 | Kozlowski et al. |
| 5,181,602 | A | 1/1993 | Kozlowski et al. |
| 5,207,315 | A | 5/1993 | Benda |
| 5,219,070 | A | 6/1993 | Grunert et al. |
| 5,225,963 | A | 7/1993 | Smart |
| 5,256,838 | A | 10/1993 | Benda |
| 5,260,528 | A | 11/1993 | Benda |
| 5,270,503 | A | 12/1993 | Frye |
| 5,290,979 | A | 3/1994 | Grass |
| 5,300,740 | A | 4/1994 | Benda |
| 5,310,969 | A | 5/1994 | Turek et al. |
| 5,322,980 | A | 6/1994 | Benda |
| 5,324,897 | A | 6/1994 | Melgoza et al. |
| 5,349,145 | A | 9/1994 | Kelaita, Jr. et al. |
| 5,357,070 | A | 10/1994 | Parsons, Jr. |
| 5,449,867 | A | 9/1995 | Kelaita, Jr. et al. |
| 5,467,622 | A | 11/1995 | Becker et al. |
| 5,468,925 | A | 11/1995 | Mohsen |
| 5,477,016 | A | 12/1995 | Baginski et al. |
| 5,500,495 | A | 3/1996 | Benda et al. |
| 5,504,284 | A | 4/1996 | Lazareth et al. |
| 5,521,344 | A | 5/1996 | De Leo |
| 5,543,593 | A | 8/1996 | Turek |
| 5,558,209 | A | 9/1996 | Mohsen |
| 5,577,599 | A | 11/1996 | Turek et al. |
| 5,593,020 | A | 1/1997 | Alexander |
| 5,610,375 | A | 3/1997 | Sinthomez |
| 5,663,862 | A | 9/1997 | Hopping-Mills |
| 5,732,815 | A | 3/1998 | Brouwer |
| 5,772,007 | A | 6/1998 | Frye |
| 5,782,341 | A | 7/1998 | Calder et al. |
| 5,794,760 | A | 8/1998 | Alexander |
| 5,817,998 | A | 10/1998 | Siebels et al. |
| 5,817,999 | A | 10/1998 | Mugan et al. |
| 5,844,186 | A | 12/1998 | Meriwether |
| 5,900,600 | A | 5/1999 | Alexander et al. |
| 5,905,236 | A | 5/1999 | Green |
| 5,909,019 | A | 6/1999 | Maloney et al. |
| 5,954,191 | A | 9/1999 | Reiter |
| 6,015,956 | A | 1/2000 | Green |
| 6,388,213 | B1 | 5/2002 | Letient et al. |
| 6,396,008 | B1 | 5/2002 | Maloney et al. |
| 6,423,913 | B1 | 7/2002 | Gupta |
| 6,469,264 | B2 | 10/2002 | Benda |
| 6,563,063 | B1 | 5/2003 | Moore |
| 6,617,532 | B1 | 9/2003 | Turek |
| 6,649,851 | B1 | 11/2003 | Hennel et al. |
| 6,680,445 | B1 | 1/2004 | Oravetz et al. |
| 6,696,651 | B1 | 2/2004 | Koopmeiners et al. |
| 6,703,572 | B1 | 3/2004 | Broghammer |
| 6,727,441 | B2 | 4/2004 | Benda |
| 6,791,040 | B1 | 9/2004 | Puhalla et al. |
| 6,844,512 | B2 | 1/2005 | Benda |
| 7,262,376 | B2 | 8/2007 | Brojanac et al. |
| 7,977,590 | B2 | 7/2011 | Brojanac |
| 2002/0139646 | A1 | 10/2002 | Karlicek |
| 2004/0099514 | A1 | 5/2004 | McCoy |
| 2004/0107744 | A1 | 6/2004 | Chen |
| 2004/0245077 | A1 | 12/2004 | Benda |
| 2006/0070861 | A1 | 4/2006 | Bogdon et al. |
| 2006/0266631 | A1* | 11/2006 | Kalous et al. ..... 200/43.14 |
| 2011/0174599 | A1 | 7/2011 | Whitaker et al. |

OTHER PUBLICATIONS

International Search Report and Written Opinion from International Application No. PCT/US2013/074938, date of mailing Apr. 22, 2014.

International Search Report for PCT Application No. PCT/US07/78647, mailed Sep. 26, 2008.

Supplementary European Search Report from EP ApplicationNo. 07 81 4889, dated Jun. 23, 2010, 6 pages.

Brady "Minature Circuit Breaker Lockout—Tie Bar 90853", website printout; http://bradyid.com/bradyid/pdpv/9085.3.html; 2013; 1 page.

Panduit "PSL-MCBNT," websit printout; http://www.panduit/com/wcs/Sattelite?c=Page&childpagename=Panduit_Global%2FPG_L . . . ; 2013; 2 pages.

Panduit Product Bulletin; "Circuit Breaker Lockout System;" 4 pages; 2013.

Catu S.A. Bagneux; The World of Electrical Safety; "Safety Padlock and Warning Signs;" 3 pages; 2009.

Gylling; "Lockout;" website printout; http://gylling.no/produckter/electro/lockout.shtml; 2 pages; 2010.

* cited by examiner

LOCKOUT DEVICE

CROSS-REFERENCE TO RELATED APPLICATION

This application claims priority to and the benefit of U.S. Provisional Patent Application Ser. No. 61/737,311, entitled "SWITCH LOCKOUT DEVICE" and filed Dec. 14, 2012, the entire disclosure of which is incorporated herein by reference.

BACKGROUND

Many switches, such as, for example, circuit breaker switches, are designed to be switched between two positions (for example, an "on" position and an "off" position) with minimal force. Additionally, a circuit breaker switch may be configured to reset certain functions of the circuit breaker when the switch is toggled to the "on" position. Switches are commonly designed to offer little resistance to position change. In application, this feature makes switches easy to use and operate. However, in some conditions, the low resistance of switches to position change can create several concerns. Accidental or unauthorized switch position changes can cause safety hazards, damage equipment or cause lost production time and/or in-process material losses. For example, a switch could be changed to an ON position while maintenance is being performed, causing machinery to activate and potentially injure a worker.

SUMMARY

According to an exemplary embodiment of the present application, a lockout device includes a body, a clamp, and a cover. The body includes a recess and a first lock passage extending from a first opening in an upper surface to a second opening in a rear surface. The clamp is assembled with a clamp retaining portion of the body. The cover is connected with the body and is movable between a lockout position covering at least a portion of the clamp and a release position uncovering the clamp to permit adjustment. The cover includes first and second cutouts. When the cover is in the lockout position, the first and second cutouts align with the first and second openings of the body to permit insertion of a lock member through the first lock passage, thereby preventing movement of the cover from the lockout position to the release position.

Another exemplary embodiment of the present application involves a method of locking out a fuse box having an end wall extending outward from a fuse receptacle to an access opening, using a lockout device including a body, a clamp, and a cover. In the exemplary method, the end wall of the fuse box is received into a recess disposed in a lower surface of the body and extending between a front clamp retaining portion of the body and a rear clamping portion of the body, such that the body at least partially blocks the fuse receptacle. The clamp is adjusted to extend into the recess and into clamping engagement with the end wall. The cover is moved from a release position, in which the clamp is uncovered to permit adjustment, to a lockout position, in which a front portion of the cover covers at least a portion of the clamp to prevent adjustment of the clamp. A lock member is secured through a lock passage defined by the lock member, such that the lock member blocks movement of the cover from the lockout position to the release position.

In another exemplary embodiment of the present application, a lockout device includes a body, a clamp, and a cover.

The body includes a recess disposed in a lower surface of the body and extending between a front clamp retaining portion and a rear clamping portion toward an upper surface of the body. The body further defines a lock passage extending between first and second openings in the body. The clamp is assembled with the clamp retaining portion of the body and is adjustably extendable into the recess for clamping engagement of an external structure when the external structure is inserted into the recess. The cover includes a front portion, an upper portion and a rear portion. The cover is assembled in arcuate sliding engagement with the body for arcuate sliding movement between a lockout position, in which the front portion of the cover covers at least a portion of the clamp to prevent adjustment of the clamp, and a release position, in which the clamp is uncovered to permit adjustment. The cover includes first and second cutouts. When the cover is in the lockout position, the first cutout aligns with the first opening of the body and the second cutout aligns with the second opening of the body, to permit insertion of a lock member through the lock passage, thereby preventing movement of the cover from the lockout position to the release position.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

The Detailed Description of the Invention merely describes exemplary embodiments of the invention and is not intended to limit the scope of the claims in any way. Indeed, the invention as claimed is broader than and unlimited by the exemplary embodiments, and the terms used in the claims have their full ordinary meaning According to an exemplary aspect of the present application, a lockout device is provided for a switch assembly having a lever or toggle switch extending from a base and movable between at least first and second switching positions. One such type of switch is an ISO-DIN type circuit breaker switch commonly used in Europe and Asia, which is dimensioned and configured in accordance with ISO and DIN standards.

Figure 1A:
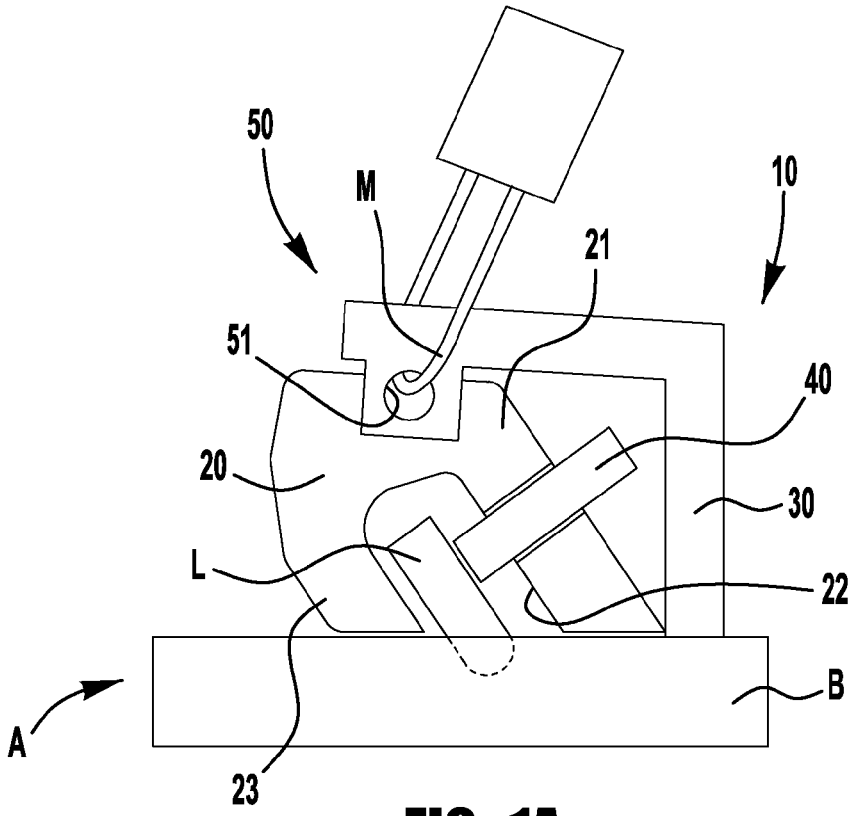
FIG. 1A is a schematic side cross-sectional view of an exemplary switch lockout device, shown assembled with a switch assembly in a lockout condition.
Figure 1B:
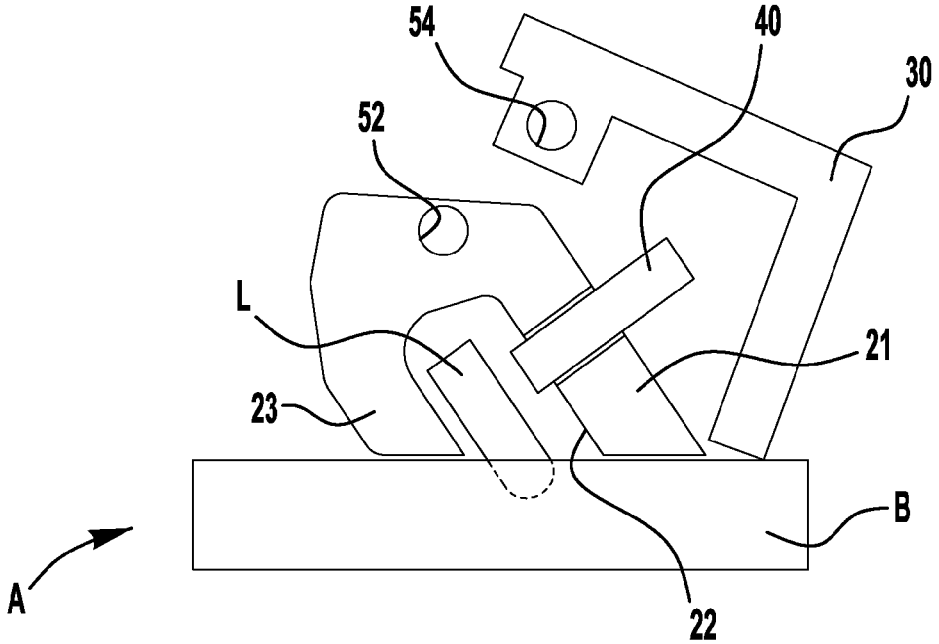
FIG. 1B is a schematic side cross-sectional view of the switch lockout device of FIG. 1A, shown assembled with the switch assembly in an unlocked condition.
Figure 2A:
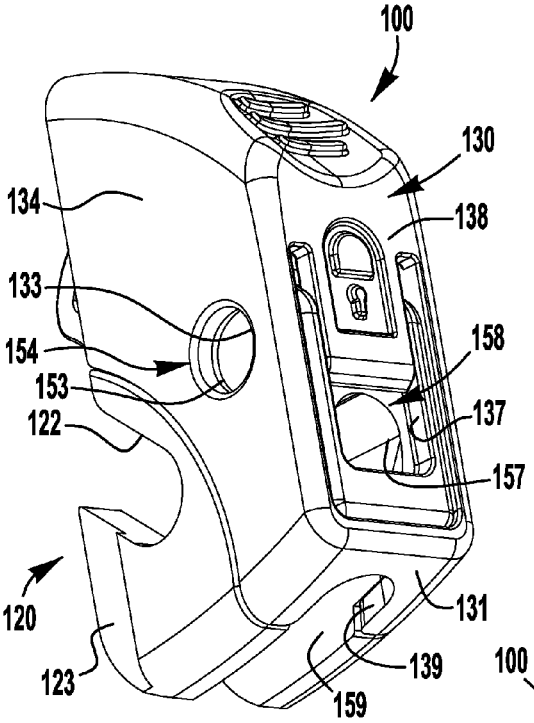
FIG. 2A is a front perspective view of an exemplary circuit breaker lockout device, shown with the cover in a lockout position.
Figure 2B:
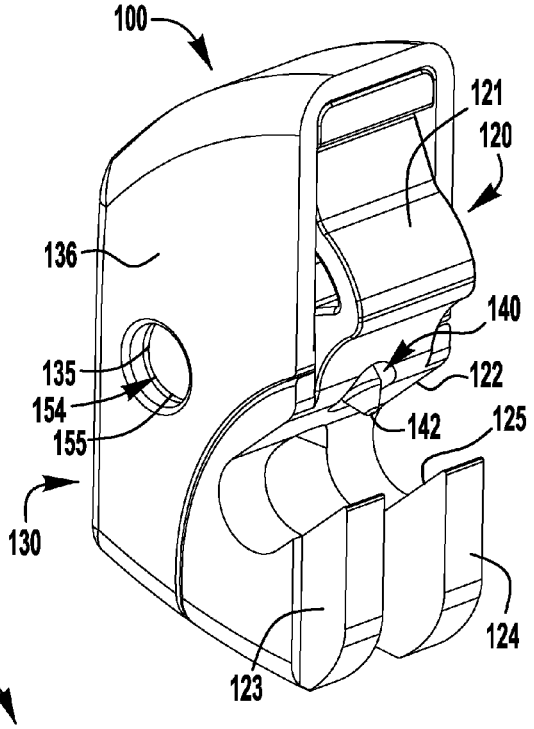
FIG. 2B is a rear perspective view of the circuit breaker lockout device of FIG. 2A, shown with the cover in a lockout position.
Figure 2C:
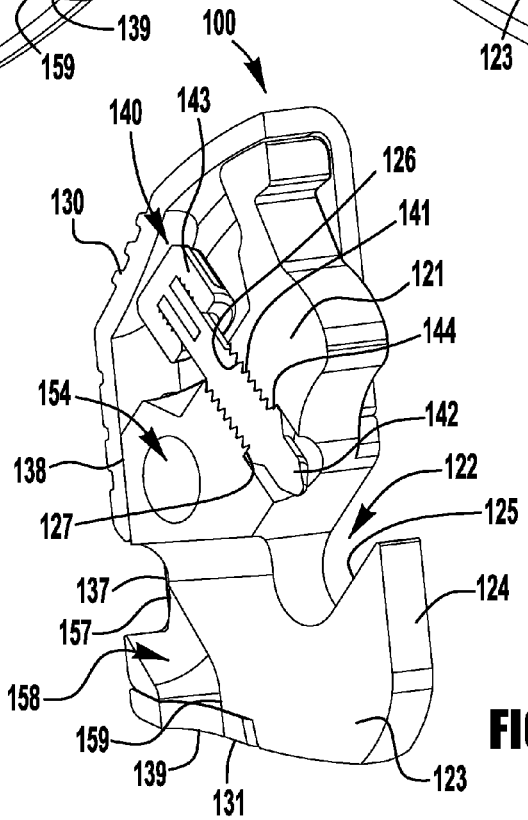
FIG. 2C is a cross-sectional perspective view of the circuit breaker lockout device of FIG. 2A, shown with the cover in a lockout position.
Figure 2D:
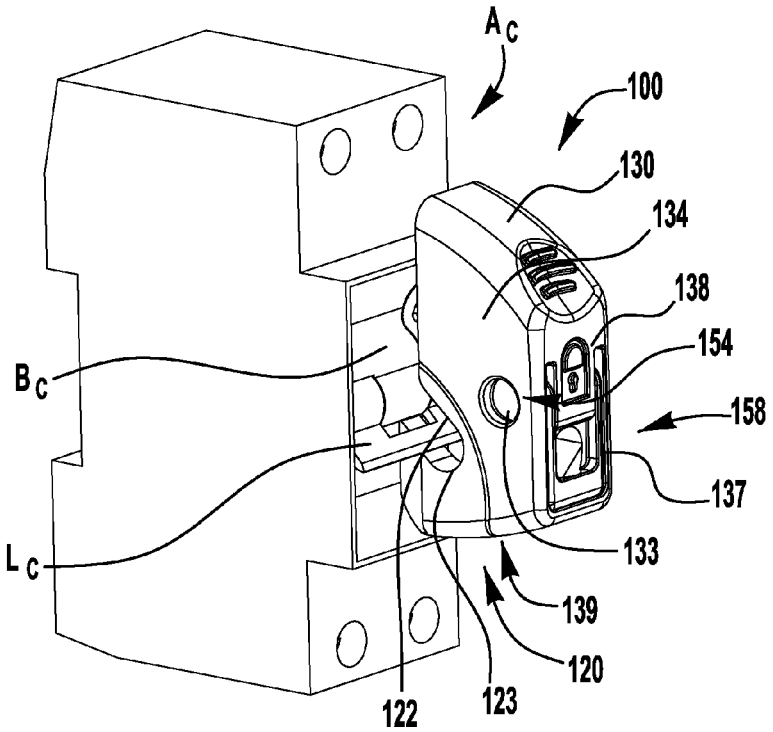
FIG. 2D is a front perspective view of the circuit breaker lockout device of FIG. 2A assembled with a circuit breaker switch assembly and shown with the cover in a lockout position.

FIGS. 1A and 1B schematically illustrates an exemplary lockout device 10 for use with a switch assembly A including a lever L that extends from a base B and is pivotable between at least first and second switching positions. The exemplary device 10 includes a body 20, a cover 30, and a clamp 40. The body 20 includes a lever receiving recess 22 disposed in a lower surface of the body between a clamp retaining portion 21 and a clamping or switch engaging portion 23 of the body 20. The recess 22 is sized to receive the lever L when the device 10 is assembled with the switch assembly A. The clamping portion 23 is shaped to engage at least one of the lever L and the base B when the device 10 is assembled with the switch assembly A. As shown, the clamp retaining portion 21 may (but need not) also be shaped to engage the base B when the device 10 is assembled with the switch assembly A, for example, to prevent pivoting of the switch lever L by moving the mounted device 10.

The clamp 40 is assembled with the clamp retaining portion 21 of the body 20 and is movable between a lever clamping position, to directly or indirectly secure the lever L in a selected switching position, and a lever releasing position, to permit movement of the lever L out of the selected switching position (e.g., either by permitting removal of the device 10 from the switch assembly A or by providing clearance for lever movement while the device 10 remains mounted to the switch assembly A). Any suitable type of clamp may be utilized, including, for example, a screw, bolt, or other threaded fastener, a friction pad, or a ratcheting cam or plunger. The cover 30 is connected with the body 20 (e.g., integrally or as an assembly) and is movable between a covering or lockout position (FIG. 1A), in which user access to the clamp 40 is blocked, and an uncovering or release position (FIG. 1B), in which user access to the clamp 40 is permitted. The cover 30 may be assembled with the body 20 in any suitable fashion, including, for example, pivotable engagement, sliding engagement, or detachable engagement. In an exemplary embodiment, the cover 30 may be shaped to engage the switch base B when in the lockout position (e.g., in addition to or instead of base engagement by the clamp retaining portion 21 of the body 20), for example, to prevent pivoting of the switch lever L by moving the locked out mounted device 10.

The exemplary device 10 includes a locking arrangement (shown schematically at 50) to secure the cover 30 in the lockout position, to prevent unauthorized movement of the clamp 40 to the lever releasing position. While many different locking arrangements may be used to secure the cover in the lockout position (including key cylinder locks, combination dial locks, or other integral locking mechanisms), in an exemplary embodiment, at least one of the body 20 and the cover 30 defines a lock passage 51 (e.g., formed from aligned holes 52, 54, see FIG. 1B) sized to receive a lock member M (e.g., a padlock shackle, locking cable, tie bar, or cinching "zip" tie) therethrough. Insertion of the lock member M through the lock passage 51 blocks movement of the cover 30 from the lockout position to the unlocked position. To move the cover 30 from the lockout position to the release position, the lock member M must be removed from the lock passage 54.

FIGS. 2A-7 illustrate an exemplary circuit breaker lockout device 100 for use with a circuit breaker assembly Ac including a lever Lc that extends from a base Bc and is pivotable between at least first and second switching positions. The exemplary device 100 includes a body 120, a cover 130, and a clamp 140. The body 120 includes a lever receiving recess 122 disposed in a lower surface of the body and extending between a clamp retaining portion 121 and a switch engaging portion 123 of the body 120. The recess 122 is sized and angled to receive the toggle lever Lc when the device 100 is assembled with the switch assembly Ac. The switch engaging portion 123 includes a first surface 124 shaped to engage the base Bc and a second surface 125, defined by the recess 122, shaped to engage an underside of the lever Lc when the device 100 is assembled with the circuit breaker assembly Ac. As shown, the clamp retaining portion 121 of the exemplary body 120 is shaped to engage the base Bc when the device 100 is assembled with the circuit breaker assembly Ac, for example, to prevent pivoting of the switch lever Lc by moving the mounted device 100. In an exemplary embodiment, the clamp retaining portion 121, lever receiving recess 122, and switch engaging portion 123 may be sized and contoured for proper engagement with one or more industry standard miniature circuit breakers, including, for example, Terasaki T6, Siemens 5SX22, and Hager MT120 circuit breakers.

The exemplary clamp 140 includes a screw portion 141 threadably engaged with a threaded bore 126 in the clamp retaining portion 121 of the body 120. The screw portion extends to a nose portion 142 sized and contoured to effectively grip the switch lever Lc without marring or otherwise damaging the lever. While the clamp may be provided with a tool engaging head (e.g., hex-shaped head, screwdriver slot, or Allen key socket) for tightening and loosening with a corresponding tool, in the illustrated embodiment, the clamp 140 includes a user graspable knob 143 for hand tightening and loosening of the clamp. In some embodiments, excluding a tool interface (e.g., screwdriver slot, etc.) from the clamp 140 may reduce the likelihood of over-tightening of the clamp 140 with the switch lever Lc, which may protect against damage.

Figure 10:
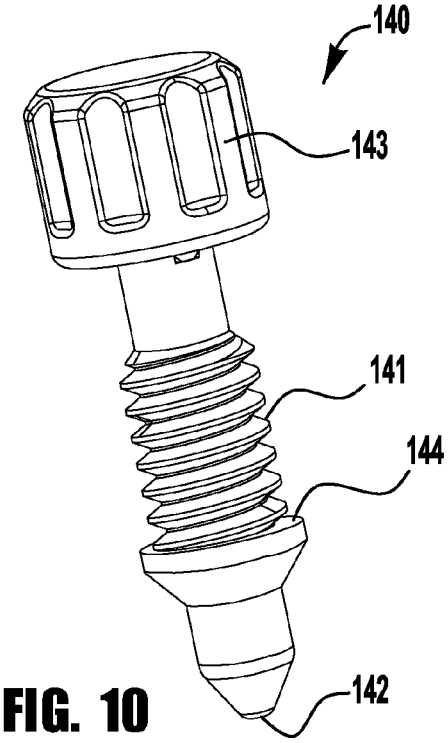
FIG. 10 is a perspective view of the clamp of the circuit breaker lockout device of FIG. 2A.
Figure 11A:
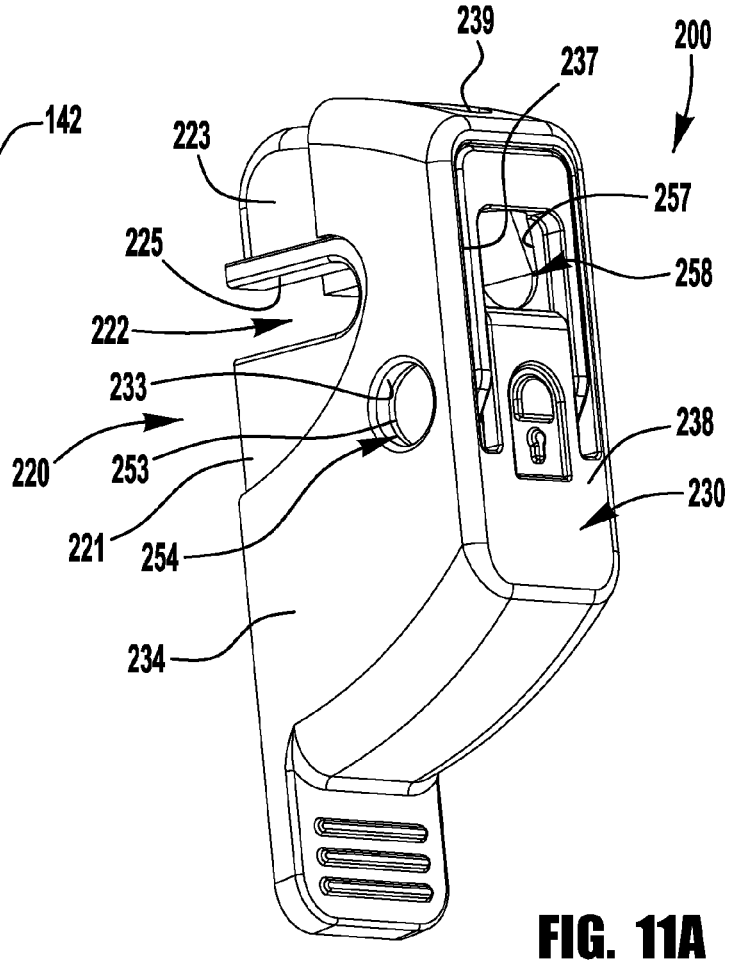
FIG. 11A is a front perspective view of an exemplary fuse lockout device, shown with the cover in a lockout position.
Figure 11B:
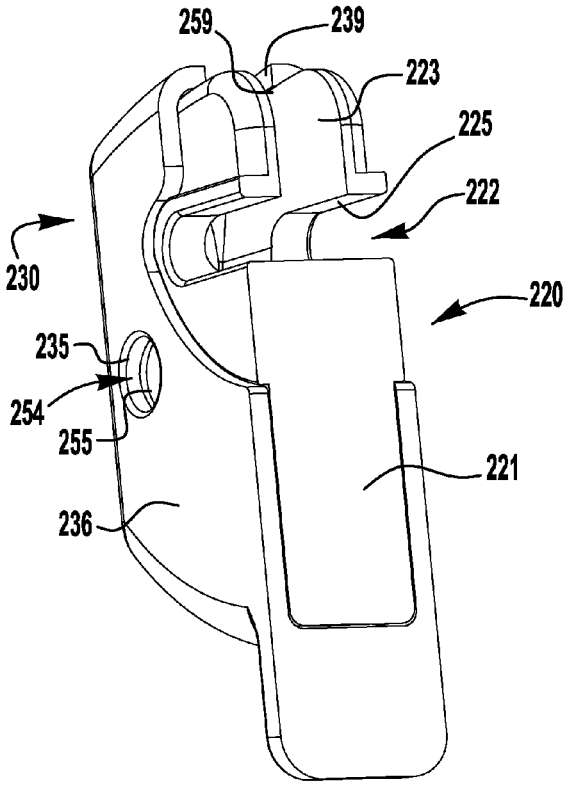
FIG. 11B is a rear perspective view of the fuse lockout device of FIG. 11A, shown with the cover in a lockout position.
Figure 11C:
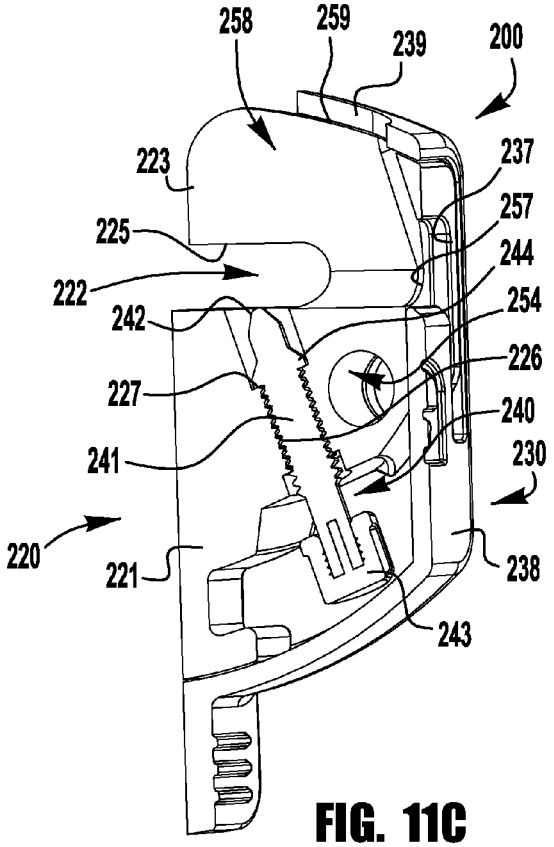
FIG. 11C is a cross-sectional perspective view of the fuse lockout device of FIG. 11A, shown with the cover in a lockout position.
Figure 11D:
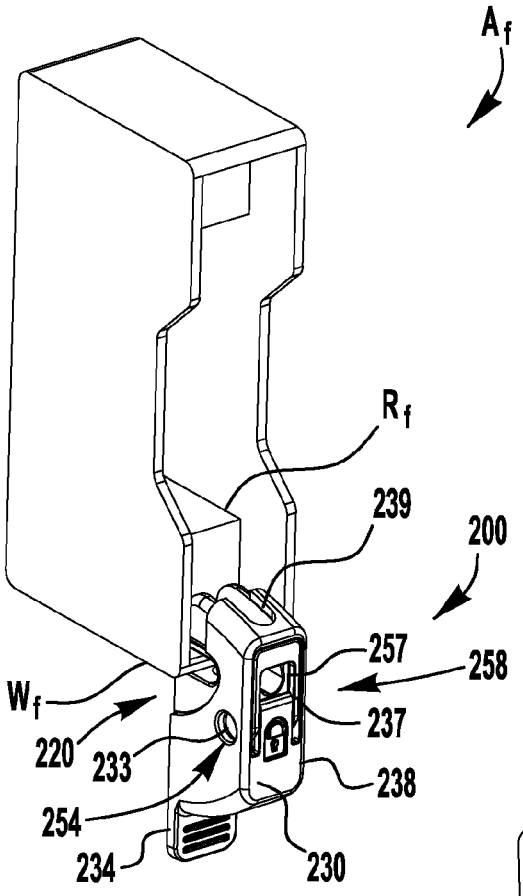
FIG. 11D is a front perspective view of the fuse lockout device of FIG. 11A assembled with a fuse box assembly and shown with the cover in a lockout position.
Figure 12:
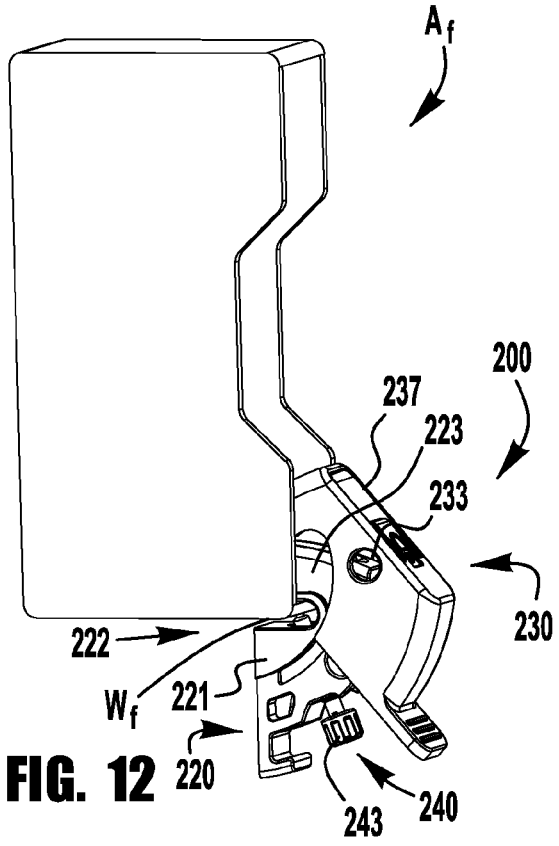
FIG. 12 is a perspective view of the fuse lockout device of FIG. 11A assembled with a fuse box assembly and shown with the cover in an unlocked position.
Figure 13:
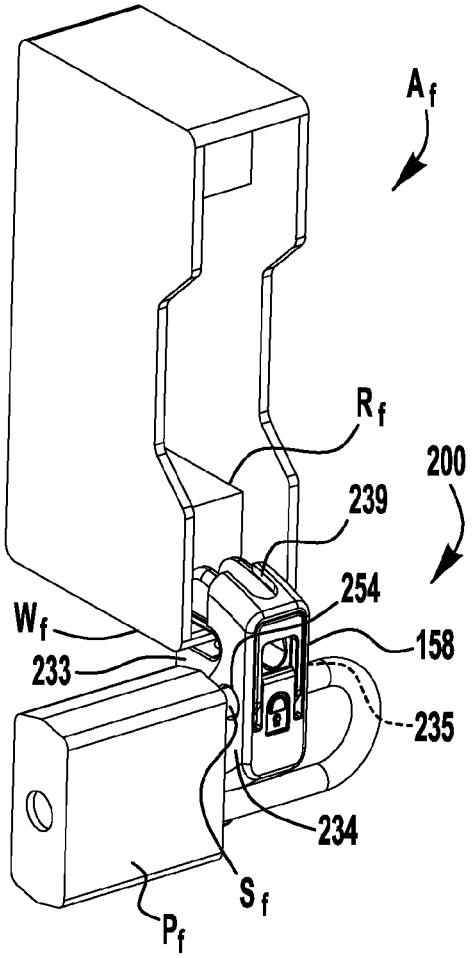
FIG. 13 is a perspective view of the fuse lockout device of FIG. 11A assembled with a fuse box assembly and shown with a padlock shackle extending through a horizontal lock passage to secure the cover in the lockout position.
Figure 14:
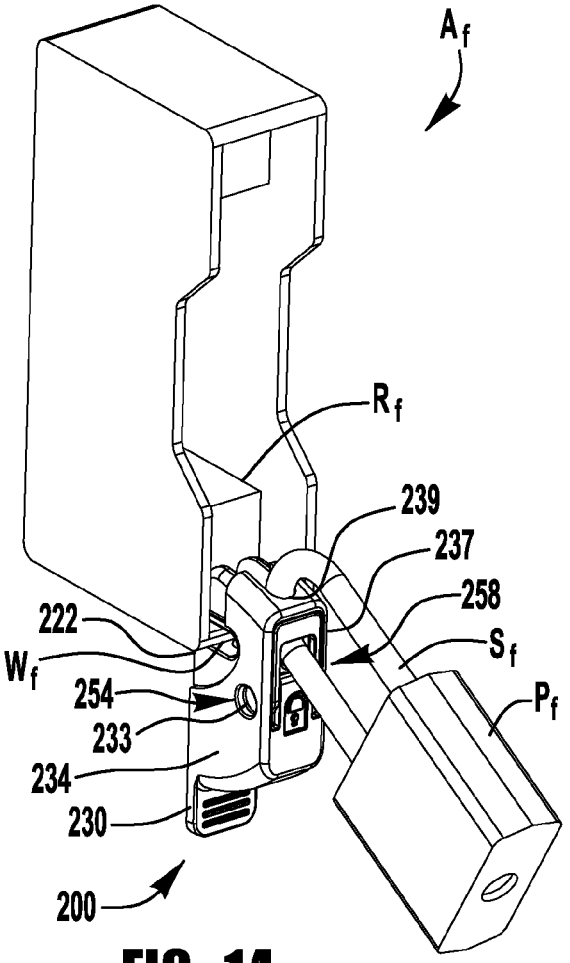
FIG. 14 is a perspective view of the fuse lockout device of FIG. 11A assembled with a fuse box assembly and shown with a padlock shackle extending through a vertical lock passage to secure the cover in the lockout position.
Figure 15:
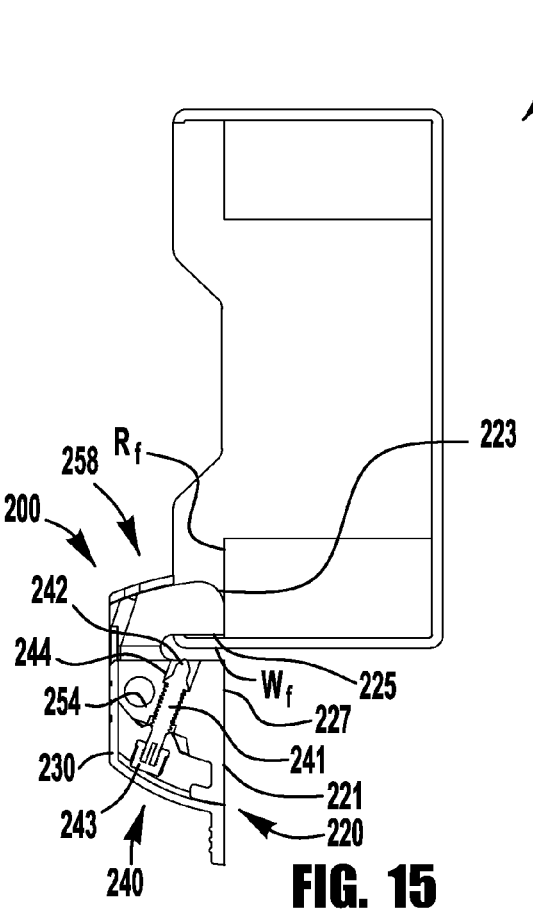
FIG. 15 is a side cross-sectional view of the fuse lockout device of FIG. 11A assembled with a fuse box assembly and shown with the cover in a lockout position.
Figure 16:
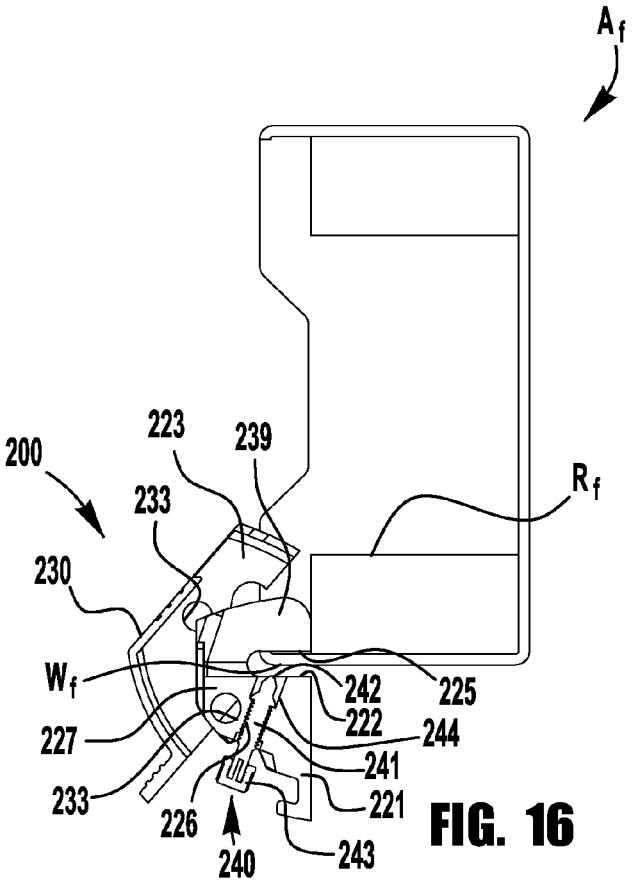
FIG. 16 is a side cross-sectional view of the fuse lockout device of FIG. 11A assembled with a fuse box assembly and shown with the cover in an unlocked position.
Figure 17:
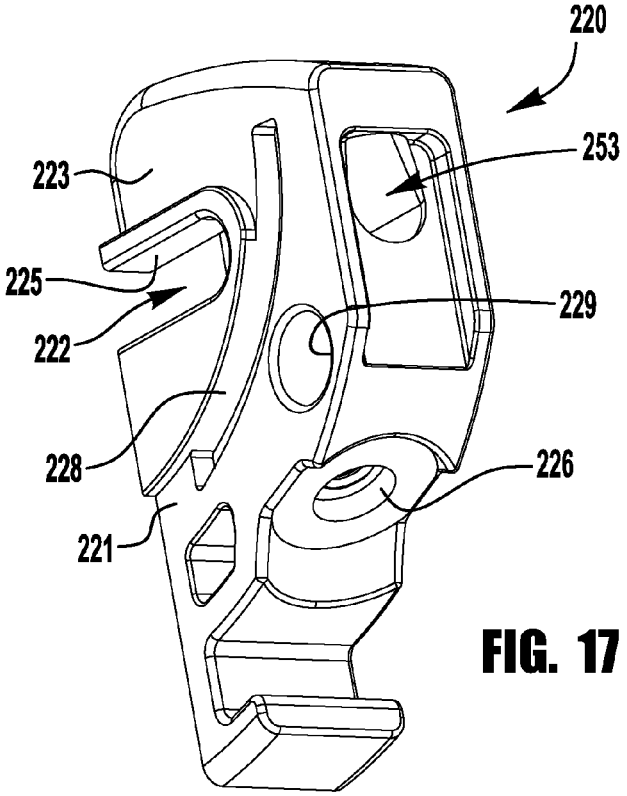
FIG. 17 is a perspective view of the body of the fuse lockout device of FIG. 11A.
Figure 18:
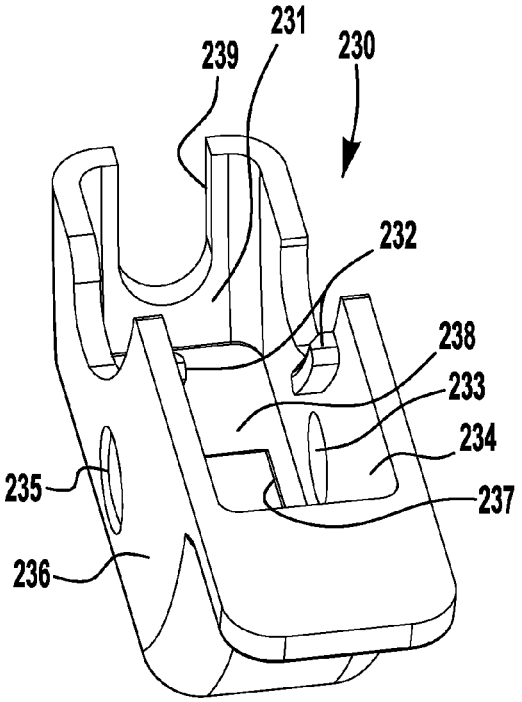
FIG. 18 is a perspective view of the cover of the fuse lockout device of FIG. 11A.

As shown in FIG. 10, the clamp 140 may additionally be provided with a shoulder stop 144 positioned to engage a shoulder 127 of the threaded bore 126 to prevent removal of the clamp 140 from the body 120. To assemble the clamp 140 with the body 120, the screw portion 141 of the clamp may be threaded upward through the bore 126 prior to attaching the knob 143 (e.g., using an adhesive, sealant, press fit, or other such arrangement).

As with the embodiment of FIGS. 1A and 1B, the clamp 140 is assembled with the clamp retaining portion 121 of the body 120 and is movable between a lever clamping position, to secure the lever Lc in the selected switching position, and a lever releasing position, to permit movement of the lever Lc out of the selected switching position, by permitting removal of the device 100 from the switch assembly Ac.

Figure 8:
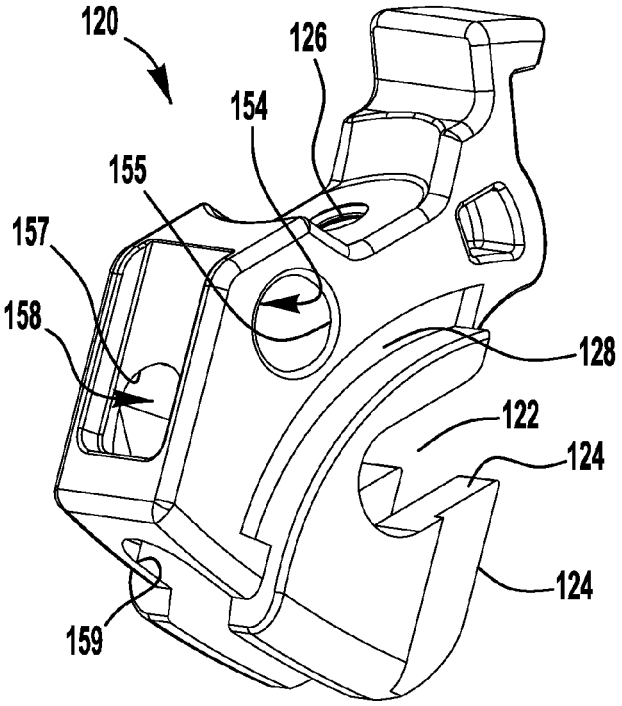
FIG. 8 is a perspective view of the body of the circuit breaker lockout device of FIG. 2A.
Figure 9:
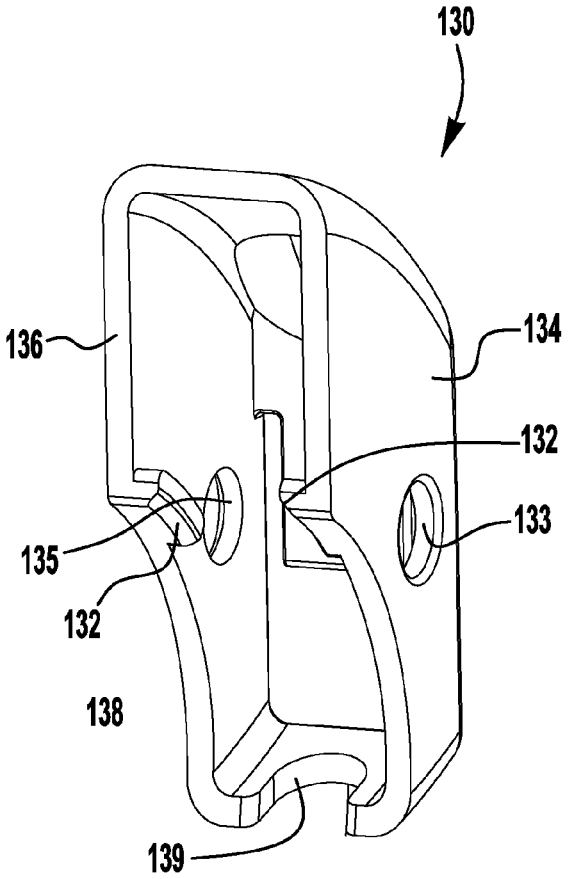
FIG. 9 is a perspective view of the cover of the circuit breaker lockout device of FIG. 2A.

Any suitable movable coupling arrangement may be utilized to secure the cover to the body while permitting movement of the cover between lockout and unlocked positions. For example, the cover may be assembled in sliding engagement with the body for sliding movement between the lockout and unlocked positions. In the illustrated embodiment, the cover 130 includes arcuate rails 132 (FIG. 9) slideably received in arcuate tracks 128 in the body 120 (FIG. 8), for arcuate sliding movement between the lockout position, in which the cover 130 substantially blocks user access to the knob 143, and the unlocked position, in which the knob 143 is exposed to permit user operation of the knob. This sliding arrangement may, for example, provide for smoother movement of the cover 130, and/or increased interlocking engagement between the body 120 and the locked out cover 130 (for example, compared to a hinged connection).

To secure the cover in the lockout position, a lock passage may be defined by one or both of the body and cover of the lockout device. When a padlock shackle or other lock member is inserted through the lock passage, movement of the cover out of the lockout position is blocked by the lock member. In one embodiment, a lockout device includes a lock passage that extends across the width of the body, or in a direction substantially parallel to the pivot axis of the switch lever with which the device is assembled. In another embodiment, a lockout device additionally or alternatively includes a lock passage that extends along a length of the body, or in a direction substantially perpendicular to the pivot axis of the switch lever with which the device is assembled.

Figure 3:
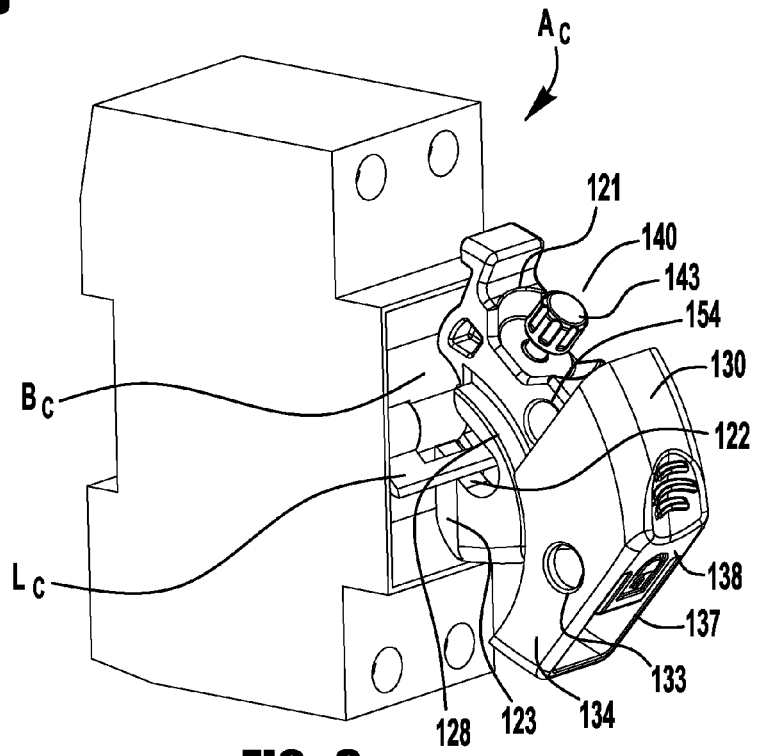
FIG. 3 is a perspective view of the circuit breaker lockout device of FIG. 2A assembled with a circuit breaker switch assembly and shown with the cover in an unlocked position.
Figure 4:
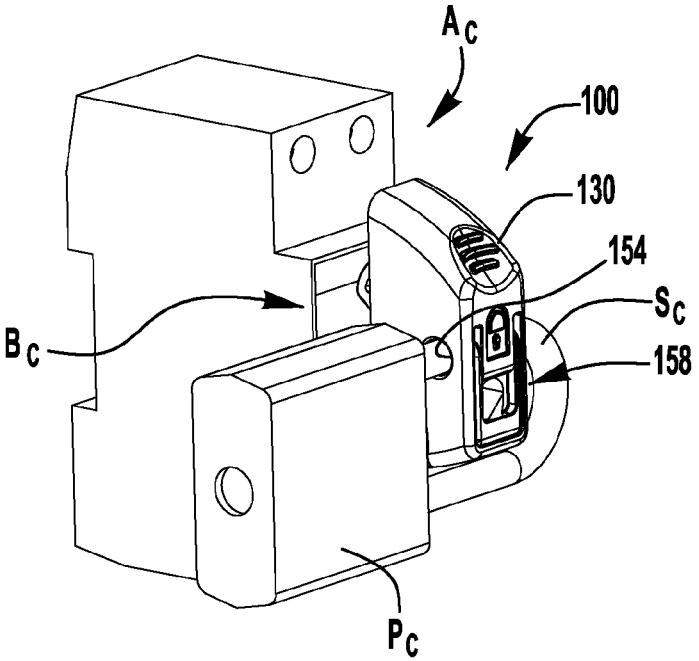
FIG. 4 is a perspective view of the circuit breaker lockout device of FIG. 2A assembled with a circuit breaker switch assembly and shown with a padlock shackle extending through a horizontal lock passage to secure the cover in the lockout position.
Figure 5:
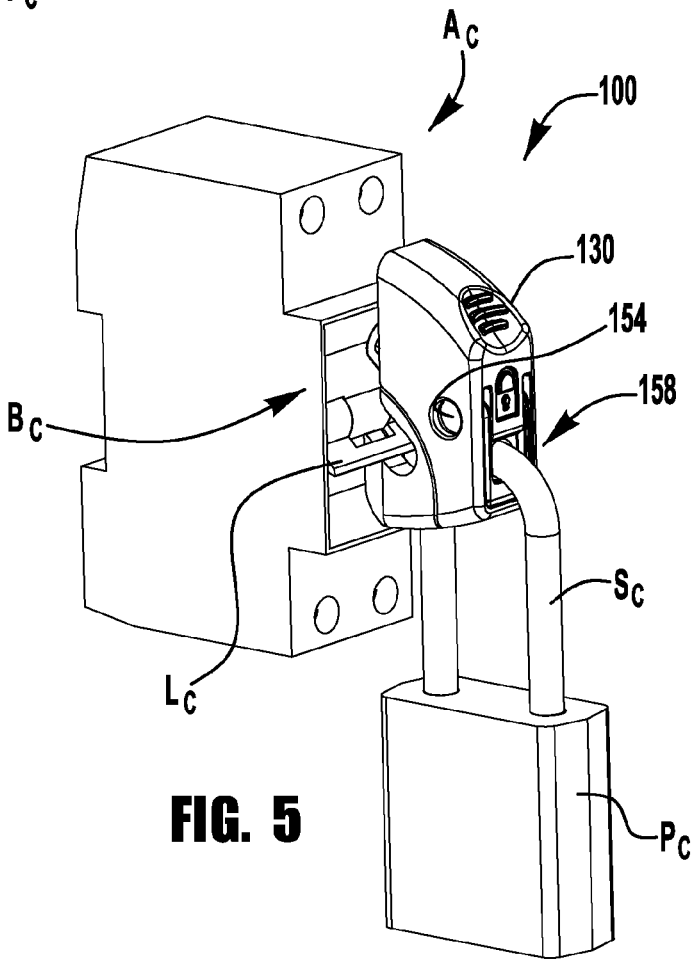
FIG. 5 is a perspective view of the circuit breaker lockout device of FIG. 2A assembled with a circuit breaker switch assembly and shown with a padlock shackle extending through a vertical lock passage to secure the cover in the lockout position.
Figure 6:
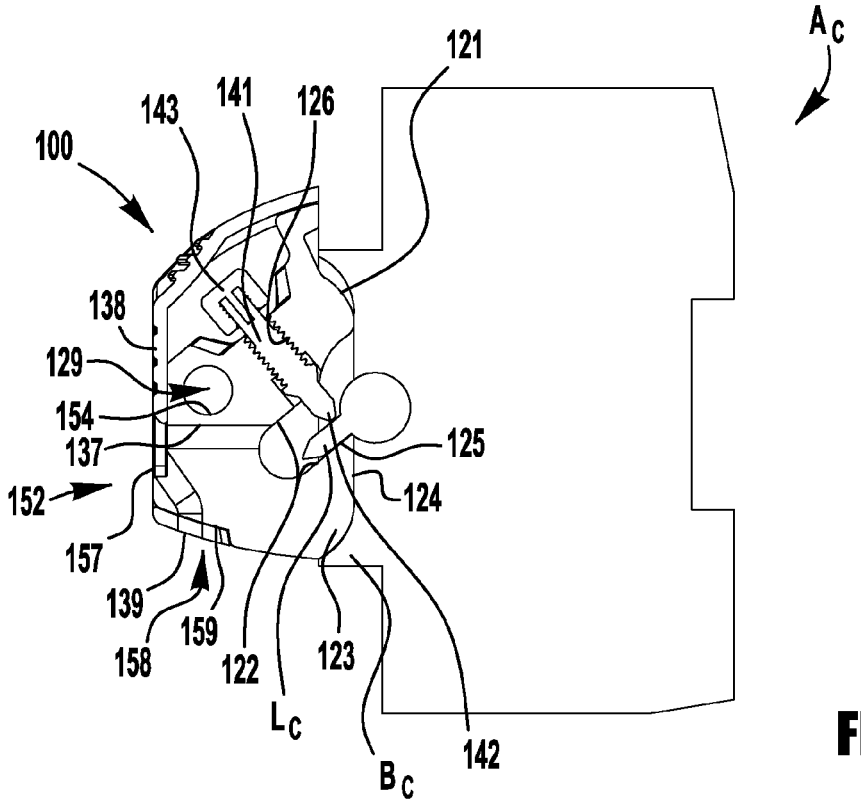
FIG. 6 is a side cross-sectional view of the circuit breaker lockout device of FIG. 2A assembled with a circuit breaker switch assembly and shown with the cover in a lockout position.
Figure 7:
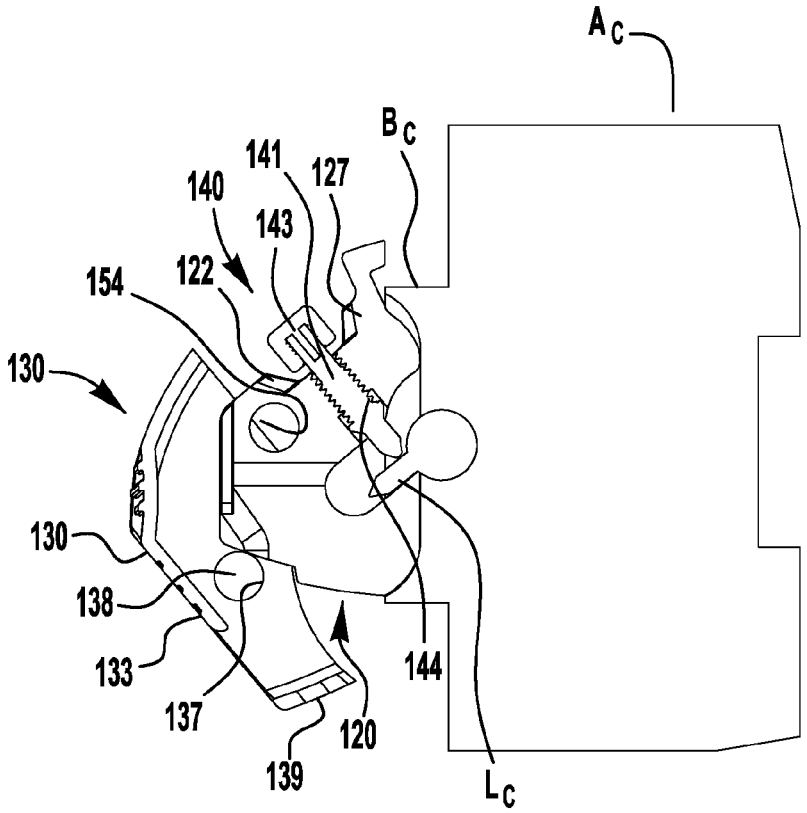
FIG. 7 is a side cross-sectional view of the circuit breaker lockout device of FIG. 2A assembled with a circuit breaker switch assembly and shown with the cover in an unlocked position.

In the illustrated embodiment, the body 120 includes a lock passage 154 extending between first and second lock openings 153, 155 in the first and second sides of the body. The cover 130 includes first and second cutouts 133, 135 in first and second side walls 134, 136. The first and second cutouts align with the first and second lock openings 153, 155 in the body 120 when the cover 130 is in the lockout position, to permit insertion of a padlock shackle Sc or other lock member (as shown in FIG. 3) through the lock passage 154, thereby securing the cover 130 in the lockout position. When a padlock shackle Sc is secured through the lock passage 154, the padlock Pc may extend in a lateral orientation beyond the side portions of a conventional circuit breaker switch assembly Ac. In an application where multiple side-by-side circuit breaker switch assemblies are to be locked out, assembly of a lockout device 100 to each of the multiple circuit breaker switch assemblies aligns the lock passages 154 of each of the lockout devices 100, allowing for lockout of the multiple circuit breaker switch assemblies with a single tie bar, locking cable, or elongated shackle padlock (not shown).

In an exemplary embodiment, a body of a lockout device may additionally or alternatively include a lock passage extending between lock openings in one or more of the upper, front, and rear portions of the body, such that the lock passage extends in a longitudinal direction with respect to the body, instead of a lateral direction across the body. In the illustrated embodiment, the body 120 includes a second lock passage 158 extending between third and fourth lock openings 157, 159 in the upper and rear portions of the body 120. As shown, the second lock passage 158 may extend substantially perpendicular to a pivot axis of the switch lever Lc, and may be arcuate or otherwise shaped to accommodate a curved portion of a shackle. The exemplary cover 130 includes a third cutout 137 in an upper wall portion 138, and a fourth cutout 139 in a rear wall portion 131 of the cover 130. When the cover 130 is in the lockout position, the third and fourth cutouts 137, 139 align with the third and fourth lock openings 157, 159 to permit insertion of a lock member through the second lock passage 158, thereby securing the cover 130 in the lockout position.

When a padlock shackle Sc is secured through the second lock passage 158, the padlock Pc may extend in an axial orientation, such that a properly sized padlock Pc does not extend beyond the side portions of a convention circuit breaker switch assembly Ac. In an application where multiple side-by-side circuit breaker switch assemblies are to be locked out, installation of padlocks with the second lock passages 158 of lockout devices 100 assembled with each of the multiple circuit breaker switch assemblies Ac allows for clearance between the installed padlocks (not shown). While the exemplary third and fourth cutouts 137, 139 form separate, discrete apertures in the cover 130, in another embodiment (not shown), the third and fourth cutouts may form a single elongated aperture extending to expose the third and fourth lock openings when the cover is in the lockout position.

A lockout device having one or more of the features of the exemplary lockout devices described above may be used to lock out other types of equipment, including, for example, valve handles, buttons, electrical outlets or plugs, and fluid system connections. In one embodiment, a lockout device may be configured to clamp onto an equipment housing or other structural feature in a position blocking access to an operable, connectable, or removable component, to block access to the component. As one example, a lockout device may be secured to a wall of a fuse box to at least partially cover a fuse receptacle, for example, to prevent removal or insertion of a fuse in the fuse receptacle.

FIGS. 11A-16 illustrate an exemplary fuse lockout device 200 for use with a fuse box assembly Af including a fuse receptacle Rf disposed within a fuse box housing Hf including at least a first wall Wf extending outward of the fuse receptacle Rf. The exemplary device 200 includes a body 220, a cover 230, and a clamp 240. The body 220 includes a wall receiving recess 222 disposed between a clamp retaining portion 221 and a wall engaging portion 223 of the body 220. The recess 222 is sized to receive the first wall Wf when the device 200 is assembled with the fuse box assembly Af. The wall engaging portion 223 includes an inner surface 225 shaped to engage the first wall Wf when the device 200 is assembled with the fuse box assembly Af.

As shown, the clamp 240 of the fuse lockout device 200 may be substantially the same as the knob-handled screw-type clamp 140 of the device 100 of FIGS. 2A-7. Other types of clamps (e.g., tool-driven fasteners, friction pads, ratcheting cams or plungers) may additionally or alternatively be utilized. The clamp 240 may additionally be provided with a shoulder stop 244 positioned to engage a shoulder 227 of the threaded bore 226 to prevent removal of the clamp 240 from the body 220. To assemble the clamp 240 with the body 220, the screw portion 241 of the clamp may be threaded upward through the bore 226 prior to attaching the knob 243 (e.g., using an adhesive, sealant, press fit, or other such arrangement).

The clamp 240 is assembled with the clamp retaining portion 221 of the body 220 and is movable between a wall clamping position and a wall releasing position. In the wall clamping position, the device 200 grips the wall Wf between the clamp 240 and the inner surface 225 of the wall engaging portion 223 of the body 220, to secure the device 200 in a position that blocks access to the fuse receptacle Rf. In the wall releasing position, the device 200 is removable from the fuse box assembly Af to permit access to the fuse receptacle Rf.

Any suitable movable coupling arrangement may be utilized to secure the cover to the body while permitting movement of the cover between lockout and unlocked positions. As shown, the cover 230 and body 220 coupling arrangement may be substantially the same as the arcuate sliding arrangement of the lockout device 100 of FIGS. 2A-7.

Any suitable locking arrangement may be utilized to secure the cover in the lockout position. As shown, the cover 230 may be provided with cutouts 233, 235, 237, 239 positioned in the side walls 234, 236, upper wall 238, and rear wall 231 of the cover to expose first and second lock passages 254, 258 in the body 220 when the cover 230 is in the lockout position, and may, but need not, be substantially the same as the cutouts and passages provided in the lockout device 100 of FIGS. 2A-7.

In an exemplary method of locking out a fuse box having an end wall extending outward from a fuse receptacle to an access opening, using the exemplary lockout device 200 of FIGS. 11A-16, an end wall Wf of the fuse box is inserted into the recess 222 in the body 220, and the clamp 240 is adjusted to extend into the recess 222 and into clamping engagement with the end wall Wf. The cover 230 is moved from the release position to the lockout position. A lock member (e.g., padlock shackle Sf) is secured through one of the lock passages 254, 258 defined by the body 220, such that the lock member blocks movement of the cover 230 from the lockout position to the release position.

The bodies, covers, and clamps of the lockout devices described herein may be provided in any suitable material, including, for example, polycarbonate or PBT.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lockout device comprising:

a body having first and second laterally spaced outer side walls extending longitudinally between opposed front and rear surfaces of the body, and extending vertically between opposed upper and lower surfaces of the body, the body including a recess disposed in the lower surface of the body and extending between a front clamp retaining portion of the body and a rear clamping portion of the body, wherein the body further defines a lock passage extending longitudinally from a first opening in the upper surface of the body to a second opening in the rear surface of the body;

a clamp assembled with the clamp retaining portion of the body and adjustably extendable into the recess for clamping engagement of an external structure when the external structure is inserted into the recess; and a cover including a front portion, a rear portion, and an upper portion extending between the front portion and the rear portion, the cover being connected with the body and movable between a lockout position, in which the front portion of the cover covers at least a portion of the clamp to prevent adjustment of the clamp, and a release position, in which the clamp is uncovered to permit adjustment;

wherein the cover includes a first cutout in the upper portion and a second cutout in the rear portion, wherein when the cover is in the lockout position, the first cutout aligns with the first opening of the body and the second cutout aligns with the second opening of the body, to permit insertion of a lock member through the first lock passage, thereby preventing movement of the cover from the lockout position to the release position; and wherein the lock passage comprises a first lock passage, and wherein the body further defines a second lock passage extending through the clamp retaining portion and from a third opening in a first side surface of the body to a fourth opening in a second side surface of the body opposite the first side surface, and wherein the cover includes third and fourth cutouts that align with the third and fourth openings of the body when the cover is in the lockout position, to permit insertion of a lock member through the second lock passage, thereby preventing movement of the cover from the lockout position to the release position.

2. The lockout device of claim 1, wherein the clamp comprises a threaded fastener having a user operable knob.

3. The lockout device of claim 2, wherein the fastener includes a shoulder stop sized to about an inner surface of the clamp retaining portion of the body to prevent removal of the fastener from the body.

4. The lockout device of claim 1, wherein the recess in the body is angled to receive a toggle switch lever.

5. The lockout device of claim 1, wherein the cover is assembled in sliding engagement with the body for sliding movement between the lockout and release positions.

6. The lockout device of claim 1, wherein the cover is assembled in arcuate non-pivoting sliding engagement with the body for arcuate sliding movement between the lockout and release positions.

7. The lockout device of claim 1, wherein one of the cover and the body includes first and second projections slideably received in first and second arcuate tracks in the other of the cover and the body for arcuate sliding movement of the cover between the lockout and release positions.

8. The lockout device of claim 1, wherein the first and second lock cutouts form two separate apertures in the cover.

9. The lockout device of claim 1, wherein the lower surface and the recess of the body are sized and oriented to receive a circuit breaker switch lever.

10. The lockout device of claim 1, wherein the lock passage includes an arcuate portion shaped to accommodate a curved portion of a padlock shackle.

11. A method of locking out a component using a lockout device comprising a body having first and second laterally spaced outer side walls extending longitudinally between opposed front and rear surfaces of the body, and extending vertically between opposed upper and lower surfaces of the body, a clamp, and a cover, the method comprising:

receiving the component into a recess disposed in the lower surface of the body and extending between a front clamp retaining portion of the body and a rear clamping portion of the body, such that the body at least partially blocks the component;

adjusting the clamp to extend into the recess and into clamping engagement with the component;

moving the cover from a release position, in which the clamp is uncovered to permit adjustment, to a lockout position, in which a front portion of the cover covers at least a portion of the clamp to prevent adjustment of the clamp; and securing a padlock shackle through a lock passage defined by the body, such that the padlock shackle blocks movement of the cover from the lockout position to the release position;

wherein the lock passage extends longitudinally from a first opening in the upper surface of the body to a second opening in the rear surface of the body, such that the secured padlock shackle does not extend laterally outward of the first and second side walls.

12. The method of claim 11, wherein the clamp comprises a threaded fastener and a user graspable knob.

13. The method of claim 11, wherein moving the cover to the lockout position comprises sliding the cover to the lockout position.

14. The method of claim 11, wherein moving the cover to the lockout position comprises sliding the cover to the lockout position along an arcuate path.

15. The method of claim 11, wherein securing the padlock shackle through the lock passage comprises positioning a curved portion of the shackle within an arcuate portion of the lock passage.

16. A lockout device comprising:

a body including a recess disposed in a lower surface of the body and extending between a front clamp retaining portion of the body and a rear clamping portion of the body toward an upper surface of the body, wherein the body further defines a lock passage extending between first and second openings in the body;

a clamp assembled with the clamp retaining portion of the body and adjustably extendable into the recess for clamping engagement of an external structure when the external structure is inserted into the recess; and a cover including a front portion, an upper portion and a rear portion, the cover being assembled in arcuate sliding engagement with the body for arcuate non-pivoting sliding movement between a lockout position, in which the front portion of the cover covers at least a portion of the clamp to prevent adjustment of the clamp, and a release position, in which the clamp is uncovered to permit adjustment;

wherein the cover includes first and second cutouts, wherein when the cover is in the lockout position, the first cutout aligns with the first opening of the body and the second cutout aligns with the second opening of the body, to permit insertion of a lock member through the lock passage, thereby preventing movement of the cover from the lockout position to the release position.

17. The lockout device of claim 16, wherein the first opening is disposed in the upper surface of the body and the second opening is disposed in a rear surface of the rear clamping portion.

18. The lockout device of claim 16, wherein the first opening is disposed in a first side surface of the body and the second opening is disposed in a second side surface of the body opposite the first side surface.

19. The lockout device of claim 16, wherein one of the cover and the body includes first and second projections slideably received in first and second arcuate tracks in the other of the cover and the body.

20. The lockout device of claim 16, wherein the lock passage comprises a first lock passage, and wherein the body further defines a second lock passage extending from a third opening in a first side surface of the body to a fourth opening in a second side surface of the body opposite the first side surface, and wherein the cover includes third and fourth cutouts that align with the third and fourth openings of the body when the cover is in the lockout position, to permit insertion of a lock member through the second lock passage, thereby preventing movement of the cover from the lockout position to the release position.

21. The lockout device of claim 20, wherein the second lock passage extends through the clamp retaining portion.

* * * * *